US008571454B2

(12) United States Patent
Funabiki et al.

(10) Patent No.: US 8,571,454 B2
(45) Date of Patent: Oct. 29, 2013

(54) FIXING DEVICE AND IMAGE FORMING APPARATUS PROVIDED THEREWITH

(75) Inventors: Hiroshi Funabiki, Uenohara (JP); Koji Yamamoto, Toyokawa (JP)

(73) Assignee: Konica Minolta Business Technologies, Inc. (JP)

( * ) Notice: Subject to any disclaimer, the term of this patent is extended or adjusted under 35 U.S.C. 154(b) by 229 days.

(21) Appl. No.: 13/226,917

(22) Filed: Sep. 7, 2011

(65) Prior Publication Data

US 2012/0063822 A1 Mar. 15, 2012

(30) Foreign Application Priority Data

Sep. 14, 2010 (JP) ..... 2010-205372

(51) Int. Cl.
*G03G 15/20* (2006.01)

(52) U.S. Cl.
USPC ..... 399/323

(58) Field of Classification Search
USPC ..... 399/322, 323
See application file for complete search history.

(56) References Cited

U.S. PATENT DOCUMENTS 5,323,216 A * 6/1994 Mahoney ..... 399/45
7,463,858 B2 * 12/2008 Shiokawa et al. ..... 399/323
2005/0271432 A1 * 12/2005 Chiba ..... 399/328

FOREIGN PATENT DOCUMENTS

JP 2005-351939 A 12/2005

* cited by examiner

*Primary Examiner* — David Gray
*Assistant Examiner* — Gregory H Curran
(74) *Attorney, Agent, or Firm* — Cantor Colburn LLP

(57) ABSTRACT

A fixing device includes: a heating section which heats a recording material; a pressing section which presses the recording material toward the heating section; a separation claw which separates the recording material from the heating section or the pressing section; a fixing unit moving section which reciprocates the heating section, the pressing section and the separation claw in a direction perpendicular to a conveyance direction of the recording material; and a separation claw moving section which reciprocates the separation claw in the direction perpendicular to the conveyance direction, wherein the separation claw moving section moves the separation claw toward a direction opposite to a moving direction toward which the heating section, the pressing section and the separation claw move in the direction perpendicular to the conveyance direction.

9 Claims, 7 Drawing Sheets

FIXING DEVICE AND IMAGE FORMING APPARATUS PROVIDED THEREWITH

This application is based on Japanese Patent Application No. 2010-205372 filed on Sep. 14, 2010, which is incorporated hereinto by reference.

BACKGROUND OF THE INVENTION

The present invention relates to a fixing device and an image forming apparatus provided therewith.

Conventionally, image forming apparatuses are known that are provided with a fixing device in which a nip region is formed using two rollers, a heating roller (heating section) and a pressure applying roller (pressing section), and passing through that nip region a recording material carrying a toner image thereby fixing it.

In such image forming apparatuses, generally, recording materials of the same size are conveyed at the same position in a direction perpendicular to the conveying direction of the recording materials.

Therefore, when a large number of sheets of the same size are conveyed successively, paper dust and resins contained in the toner are supplied and taken away successively by the sheets in the area in which sheets are conveyed. On the contrary, in the area in which the sheets are not conveyed, paper dust and materials contained in the toner are almost never brought in.

In addition, in the area in which sheets are conveyed, generally, a mechanical load is placed on the heating roller by the step caused by the leading and trailing edges of the sheet and due to undulations on the surface.

Due to the differences in these contacting materials and surface conditions, the surface condition of the heating roller in the area in which the sheets are conveyed was different from the surface condition in the area in which sheets are not conveyed.

Since the state after fixing (such as the glossiness) is affected strongly by the surface condition of the heating roller, if a sheet is conveyed that is larger in size than the sheet that was conveyed previously, due to the above problem, the glossiness or the like were sometimes different in the area in which sheets were being conveyed and in the area in which sheets were not being conveyed bordering on the border between these two areas, and in this case they appeared as image defects (uneven gloss or the like), which was a problem in image forming apparatuses which are required to provide high image quality.

This is because, if the border is clear, the human eye can easily recognize optical differences (attention is being paid in the present invention to uneven gloss), and recognizes as a defect even if the difference in terms of numerical values is small.

Further, since the force of adhesion between the heating roller and the recording material is increased by the molten toner inside the nip region, the recording material gets wound around the heating roller.

In order to solve this problem, measures have been taken such as coating a mold release agent on the heating miler, making the toner contain a low melting point wax which is made to ooze out during fixing, thereby making the heating miler and the recording material easy to separate.

However, because of increasing the speed stable separation was not possible, since the heating roller becomes larger in diameter, the curvature becomes small, and even the speed of the sheet becomes higher. In addition, as a supplementary separating means, a separation claw is being used which mechanically supplements the separation of the recording material when its front edge is made to enter between the recording material and the heating roller.

In order to prevent the image defects (uneven gloss) described above and wrapping of the recording material around the heating roller, a fixing device has been proposed (see Japanese Patent Application Publication No. 2005-351939) wherein, by accommodating inside the same frame the heating roller and a plurality of separation claws that separate the recording material from the heating roller, and by making that frame carry out reciprocating motion in a direction perpendicular to the direction of conveying the recording material, it is ensured that the recording sheet is not conveyed at a fixed position on the heating roller, and also, the plurality of separation claws are made to contact the surface of the heating roller thereby separating the recording material.

However, in the fixing device described in the Japanese Patent Application Publication No. 2005-351939, since the heating roller and a plurality of separation claws are accommodated inside the same frame, at the time that the heating roller is moved in a direction perpendicular to the direction of conveying the recording material, even the plurality of separation claws move together with the heating roller.

Since the separation claws move in this manner, the positional relationship between the sheet and the plurality of separation claws changes, and depending on the dimensions of the sheet and the positions of attaching the separation claws, the separation claws may not be able to butt against the edge part of the recording material that is being conveyed at a predetermined position.

If the separation claws do not butt against the recording material, there was the problem that the recording material is not properly separated from the heating roller, a recording material separation defect (paper jamming) occurs, and as a result the operating rate of the image forming apparatus decreases.

In view of the problems described above, an object of the present invention is to provide fixing device that, in addition to suppressing the generation of image defects (uneven gloss or the like), can prevent separation failure of the recording material, and can suppress the reduction in the operation rate caused by separation failure.

SUMMARY OF THE INVENTION

The above object can be achieved by the following structures.

1. To achieve at least one of the abovementioned objects, a fixing device reflecting one aspect of the present invention has: a heating section which heats a recording material; a pressing section which presses the recording material toward the heating section; a separation claw which separates the recording material from the heating section or the pressing section; a fixing unit moving section which reciprocates the heating section, the pressing section, and the separation claw in a direction perpendicular to a conveyance direction of the recording material; and a separation claw moving section which reciprocates the separation claw in the direction perpendicular to the conveyance direction, wherein the separation claw moving section moves the separation claw toward a direction opposite to a moving direction toward which the heating section, the pressing section and the separation claw move in the direction perpendicular to the conveyance direction.

2. In the fixing device of 1 above, it is preferable that, the heating section, the pressing section, the separation claw, and the separation claw moving section are provided on a fixing unit frame that is movably supported and reciprocated by the fixing unit moving section in the direction perpendicular to the conveyance direction, and the separation claw moving section reciprocates the separation claw so that a change of a relative position of the separation claw with respect to a conveyance position of the recording material, which is caused by reciprocation movement of the fixing unit moving section, is canceled.

3. In the fixing device of 1 above, it is preferable that the separation claw comes into contact with the pressing section and separates the recording material from the pressing section.

4. In the fixing device of 1 above, it is preferable that the separation claw comes into contact with the heating section and separates the recording material from the heating section.

5. In the fixing device of 2 above, it is preferable that the fixing unit moving section continuously reciprocates the fixing unit frame, and the separation claw moving section continuously reciprocates the separation claw.

6. In the fixing device of 1 above, it is preferable that an air blowing section is provided on a downstream side of a nip portion between the heating section and the pressing section where the separation claw and the separation claw moving section are not arranged, the air blowing section blowing air against the nip portion thereby separates the recording material from the heating section or the pressing section.

7. An image forming apparatus having an image forming section which forms a toner image, and the fixing device according to 1 above, which fixes the toner image formed by the image forming section on to the recording material.

8. The fixing device of 2 above, wherein the separation claw moving section are provided inside the fixing unit frame.

9. The fixing device of 2 above, wherein the separation claw moving section are provided outside the fixing unit frame.

DETAILED DESCRIPTION OF THE PREFERRED EMBODIMENT

Before the different structures are explained, the terminology used is explained. In the following explanations, upstream refers to the side (the direction) from which the sheet which is the recording material comes flowing, and downstream refers to the side (the direction) towards which the sheet flows out, and in the following, a recording material which includes resin sheets and paper are referred to as 'sheets'.

Further, a horizontal direction parallel to the direction of conveying the sheet is called the horizontal direction Y, and, in the horizontal plate that generally overlaps the recording material in the nip region, a direction perpendicular to the horizontal direction Y is called the perpendicular direction X.

Figure 1:
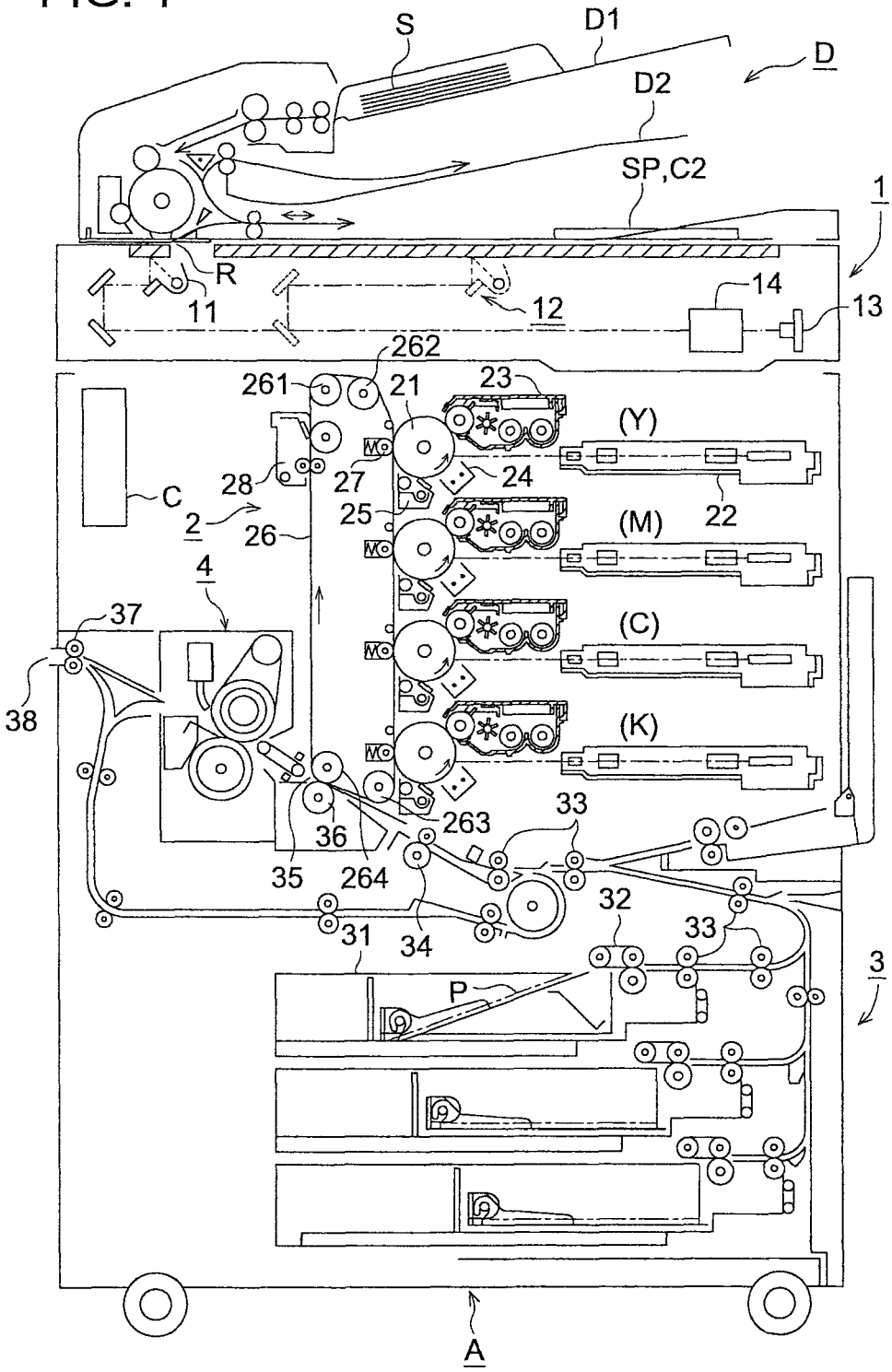
FIG. 1 is an explanatory diagram of an image forming apparatus.

FIG. 1 is an explanatory diagram of an image forming apparatus.

As an example of an image forming apparatus, the explanations are given in the following taking the example of an image forming apparatus A which is called a tandem type full color copying machine.

The automatic document feeder D picks up the document S stacked in a sheet feeding tray D1 in one sheet at a time and conveys it to the document reading area R, and discharges the document S, the information of whose image has been read in the document reading area R, to a sheet discharging tray D2.

The document image reading section 1 is provided with a light source 11, a movable scanning unit 12, and an optical system 14 that focuses the image of the document on to a line image sensor 13.

For example, in the case of a stationary optical system type reading operation, the scanning unit 12 is fixed at the document reading area R, and the image of the document (not shown in the figure) conveyed by the automatic document feeder D is read out. Further, in the case of a moving optical system type reading operation, the scanning unit 12 is moved and the image of the document placed on the document image reading section 1 is read out.

The analog signal by the photoelectric conversion of the document image by the line image sensor 13 is subjected to analog processing, A/D conversion, shading correction, image compression processing and soon in the image processing section not shown in the figure, and becomes the digital image data of each of the colors of Y (Yellow), M (Magenta), C (Cyan), and K (Black).

Surrounding each drum-shaped photoreceptor 21 (21Y, 21M, 21C, and 21K), which is the first image bearing body, are arranged respectively, an exposing section 22 (22Y, 22M, 22C, and 22K) for forming a latent image based on the digital image data of each color, a developing section 23 (23Y, 23M, 23C, and 23K) that develops using a toner the latent image corresponding to each color, a charging section 24 (24Y, 24M, 24C, and 24K) which uniformly charges the photoreceptor 21, and a cleaning section 25 (25Y, 25M, 25C, and 25K) which removes the toner remaining on the surface of the photoreceptor 21 without being transferred on to an intermediate transfer member 26.

Here, the photoreceptor 21, the exposing section 22, and the developing section 23 form an image forming section 2 that forms a toner image.

Further, opposite each photoreceptor 21 (21Y, 21M, 21C, and 21K) is positioned a semiconducting endless belt-shaped intermediate transfer member 26 which is trained about rollers 261, 262, 263, and 264 in a rotatable manner, where the intermediate transfer member 26 is driven by a driving device not shown in the figure via the roller 263 in the direction of the arrow.

The toner images of different colors borne by each of the photoreceptors 21 are successively transferred onto the intermediate transfer member 26 by the application of pressure by the primary transfer roller 27 (27Y, 27M, 27C, and 27K), and a synthesized color image is formed.

The toner that is not transferred to the sheet P but that has remained on the intermediate transfer member 26 is removed by a cleaning section 28.

A sheet feeding section 3 has a plurality of sheet feeding cassettes 31 which are sheet storing members, and sheets P are stored inside each sheet feeding cassette 31.

The stored sheets P are picked up one sheet at a time by a sheet feeding roller 32, is conveyed via a plurality of conveying rollers 33 and a registration roller 34 up to the transfer area 35, and the toner image formed on the intermediate transfer member 36 is transferred in a single operation to the conveyed sheet P by the application of pressure by a secondary transfer roller 36.

The sheet P onto which the toner image has been transferred is curved and separated from the intermediate transfer member 26, and the toner image is fixed onto the sheet P by a fixing device 4.

Next, the sheet onto which the toner image has been fixed is gripped by the sheet discharging rollers 37 and is discharged to outside the apparatus from the sheet discharging outlet 38.

Further, the above operations are controlled by a control section C which controls the entire image forming apparatus.

In the above, although the explanations were given taking the example of a full color copying machine having a plurality of photoreceptors, exposure sections, and developing sections, it goes without saying that the fixing device 4 can be applied to a monochrome copying machine having only one photoreceptor, one exposure section, and one developing section.

Figure 2:
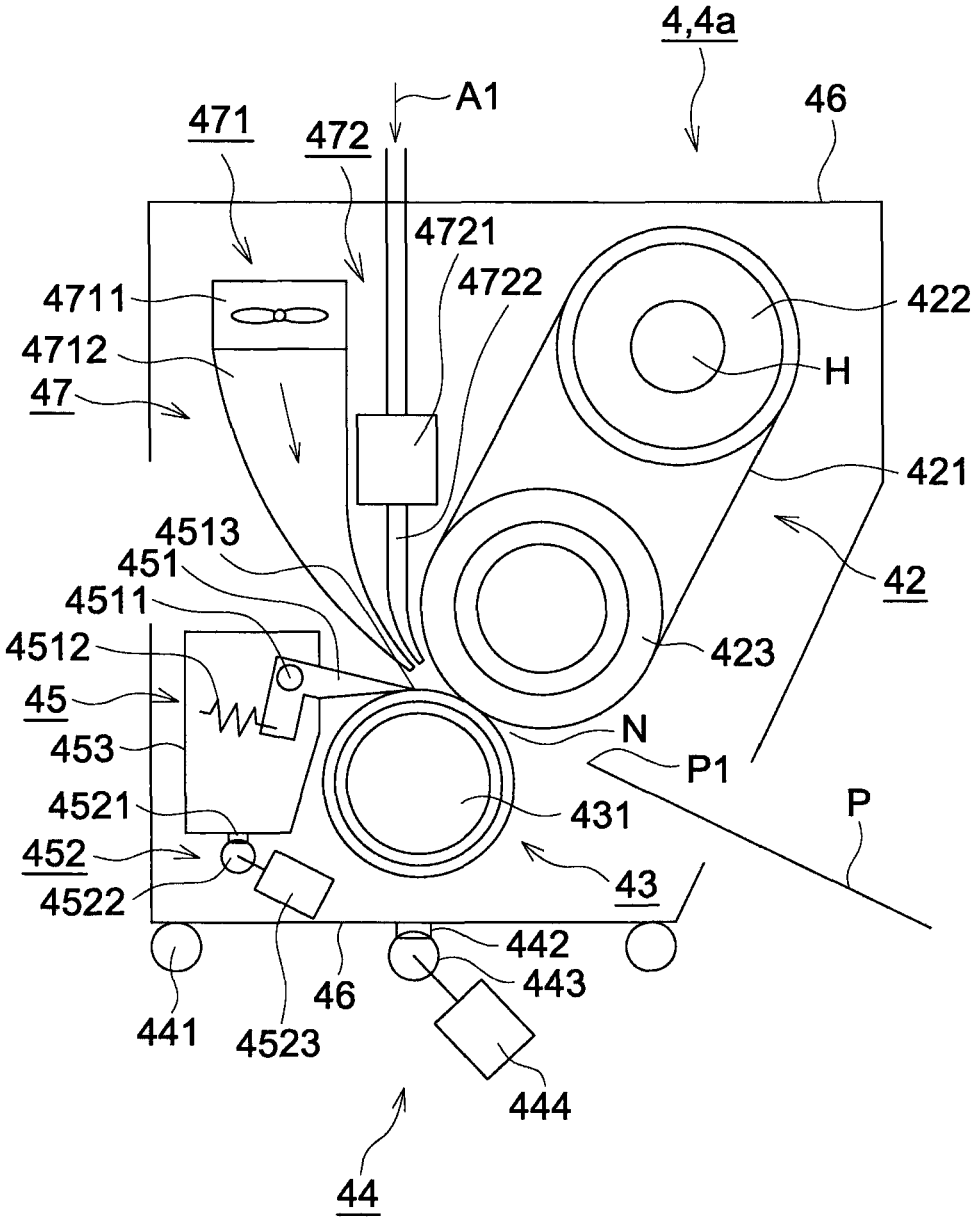
FIG. 2 is an explanatory diagram (side view diagram) of a first preferred embodiment of the fixing device.

FIG. 2 is an explanatory diagram (side view diagram) of a first preferred embodiment of the fixing device.

In this figure, when image formation is carried out on one side, an unfixed toner image is formed on the top surface in the figure of the sheet P in the preceding process positioned on the right side in the figure, and when image formation is carried out on both sides, an unfixed toner image is formed on the top surface in the figure of the sheet P in the preceding process.

Next, the sheet P is conveyed with reference to the center, and in the perpendicular direction X (the sheet surface top to bottom direction), the sheet is conveyed so that central part of the conveyed sheet matches the reference position CL which is the reference position for sheet conveying.

The fixing device 4*a* of the first preferred embodiment is provided with a heating section 42 for heating the sheet P, a pressing section 43 for pressing the sheet P against the heating section 42, a fixing unit moving section 44 that carries out reciprocating movement of at least the heating section 42 and the pressing section 43 in the perpendicular direction X (the sheet surface top to bottom direction), a separating section 45 that separates the sheet P from the pressing section 43, and a guiding member not shown in the figure that guides the sheet P that has been separated from the pressing section 43 up to the sheet discharge outlet of the fixing device 4*a*.

The toner image is fixed on the sheet P conveyed to the fixing device 4*a* by the application of heat and pressure by the heating section 42 and the pressing section 43. At this time, the sheet P that has got adhered to the pressing section 43 is separated by the separating section 45, guided by guiding members not shown in the figure, and discharged from the sheet discharging outlet of the fixing device 4*a*.

The separating section 45 is provided with separation claws 451, the leading end part of which butts against the pressing section 43 and separates the sheet P from the pressing section 43, and a separation claw moving section 452 that moves the separation claws 451 in a reciprocating manner, in a direction perpendicular to the direction of conveying the sheet P, in a direction opposite to the direction in which the heating section 42 and the pressing section 43 are moving.

The heating section 42, the pressing section 43, and the separating section 45 are installed inside the fixing unit frame 46, and the fixing unit frame can be moved in a reciprocating manner in the perpendicular direction X by the fixing unit moving section 44.

Relative to the sheet P, the heating section 42 is placed on the side on which the unfixed toner image is formed in the preceding process. Further, it has a belt shaped heating belt 421 that heats the sheet P, a heating roller 422 that heats the heating belt 421, and a first pressing roller 423 that presses the heating belt 421 against a second pressing roller 431 to be described later.

Further, the heating belt 421 uses as its base a polyimide sheet with a thickness of for example, about 70 μm, the surface of which is coated with a silicone rubber with a thickness of about 200 μm, and PFA (tetra fluoro ethylene and perfluoroalkyl vinyl ether copolymer) with a thickness of about 30 μm, in that order.

Further, the heating roller 422 is, for example, a roller with an external diameter of about 90 mm, and is a cylindrical metal roller as the base with its surface coated with PTFE (poly tetra fluoro ethylene (tetra fluoride)).

The heater H incorporated inside the healing roller 422 is constructed, for example, from a halogen lamp or the like, and is controlled by the control section C so that the temperature of the heating belt 421 becomes 160° C. to 200° C.

Further the first pressing roller 423 is, for example, a roller with an external diameter of, for example, about 90 mm, is a cylindrical metal roller as the base which is covered with silicone rubber (hardness of 10 degrees: JISA) with a thickness of about 17 mm, and PTFE (poly tetra fluoro ethylene (tetra fluoride)) is coated on its surface.

Further, the pressing section 43 is placed opposite the first pressing roller 423, and has a second pressing roller 431 which presses the sheet P against the heating belt.

The second pressing roller 431 is a roller that presses the sheet P towards the first pressing roller 423, and its external diameter is, for example, about 80 mm, has a cylindrical metal roller as the base which is covered with silicone rubber (hardness of 30 degrees: JISA) with a thickness of about 1 mm whose surface is coated with PFA (tetra fluoro ethylene and perfluoroalkyl vinyl ether copolymer) with a thickness of about 30 μm.

Further, the first pressing roller 423 and the second pressing roller 431, or one of them, is driven rotationally by a driving section not shown in the figure so that the peripheral speed has the prescribed value (for example, about 500 mm/s).

Next, the fixing unit moving section 44 is provided with guide rails 441 that guide the fixing unit frame 46 along the perpendicular direction. X, a rack gear 4521 fixed to the fixing unit frame 46, a worm gear 4522 mating with the rack gear 4521, and a fixing unit moving motor 444 that moves the fixing unit frame 46 in a reciprocating manner along the perpendicular direction X by rotationally driving the worm gear 4522.

The fixing unit frame 46 is moved in a reciprocating manner along the perpendicular direction X by the fixing unit moving motor 444 rotating in the forward and reverse directions.

Next, the separating section 45 is provided with separation claws 451 that separate the sheet P from the second pressing roller 431 by butting against the second pressing roller 431 of the pressing section 43, and a separation claw moving section 452 which moves the separation claws 451 along the perpendicular direction X in a reciprocating manner, and the separation claw moving section 452 is fixed inside a separation claw frame 453.

The separation claws 451 can swing centering on a supporting shaft 4511. Further, the tip parts 4513 are pushed towards the second pressing roller 431 by an elastic member 4512 (for example, a tension spring) so that the tip parts 4513 butt against the surface of the second pressing roller 431.

Further, if it is confirmed by experiments or the like that it is very rare that the sheet P gets adhered to the second pressing roller 431, it is also possible to position so that the tips 4513 of the separation claws 451 are slightly separated from the surface of the second pressing roller 431. By separating, it is possible to prevent scratches being generated on the second pressing roller 431.

The separation claws 451 are formed from a polyimide plastic, its surface is coated with PFA (tetra fluoro ethylene and perfluoroalkyl vinyl ether copolymer) in order to improve the ability to separate from and slide along the sheet P and the second pressing roller 431, and the tip has the shape of an arc with a radius of about 0.05 mm or less.

Further, although the construction has a plurality of separation claws 451, the expression "a plurality of separation claws 451" is used when emphasizing the fact that the separation claws are plural in number, and the expression "the separation claws 451" is used when it is not particularly necessary to emphasize the fact that the separation claws are plural in number.

The separation claw moving section 452 is provided with a rack gear 4521 fixed to the separation claw frame 453, a worm gear 4522 mating with the rack gear 4521, and a separation claw moving motor 4523 that moves the separation claw frame 453 in a reciprocating manner along the perpendicular direction X (see FIGS. 3A to 3C) by rotationally driving the worm gear 4522.

The separation claw frame 453 is made to move in a reciprocating mariner along the perpendicular direction X by the separation claw moving motor 4523 rotating in the forward and reverse directions.

Further, the separation claw moving motor 4523 rotates so that the separation claws 451 move in a direction opposite to the direction of movement of the fixing unit moving section 44, and the amount of movement of the separation claw moving motor 4523 is such that the separation claws 451 move by the same distance as the distance of movement of the fixing unit moving section 44.

Further, it is also possible that the fixing unit moving section 44 is made to move in a reciprocating manner as described above by the control section C controlling the rotation of the fixing unit moving motor 444, and the separation claw frame 453 is made to move in a reciprocating manner as described above by the control section C controlling the rotation of the separation claw moving motor 4523.

As has been explained above, in the perpendicular direction X, with respect to the sheet P conveyed in a fixed position, the heating belt 421, the first pressing roller 423, and the second pressing roller 431 are moved by the fixing unit moving section 44, and in the surface of the heating belt 421 and the second pressing roller 431, by moving the border between the area in which the sheet is conveyed and the area in which no sheet is conveyed, different glossiness or the like bordering on that border is made not to stand out.

Further, by making the tips 4513 of the separation claws 451 butt against the surface of the second pressing roller 431, the tip part P1 of the fixed sheet P is scooped up, making it possible to separate from the second pressing roller 431 the sheet P that has got adhered to the second pressing roller 431.

Further, in the reciprocating movement of the separation claws 451 accompanying the reciprocating movement of the fixing unit frame 46 due to the fixing unit moving section 44, and in the reciprocating movement of the separation claws 451 due to the separation claw moving section 452, by making the direction of movement in these opposite to each other, and also by making the distances of movement in these two the same, the reciprocating movement of the separation claws 451 due to the former fixing unit moving section 44 can be cancelled out by the reciprocating movement due to the latter separation claw moving section 452.

Therefore, separation claws 451 will be in a relatively stationary state with respect to the image forming apparatus A. By doing this, the positional relationship between the separation claws 451 and the sheet P is made fixed, and it has been made possible to separate certainly the sheet P from the second pressing roller 431.

Further, it is good to provide a releasing mechanism (not shown in the figure) that releases the pressing of the separation claws 451 towards the second pressing roller 431, and to actuate the releasing mechanism, excepting from immediately before the time that the leading edge part P1 of the sheet enters the nip region N until the trailing edge part of the sheet P has completed its passage through the nip region N, and to release the pressing of the separation claws 451 towards the second pressing roller 431.

This will make it possible to avoid the contact marks generated on the surface of the second pressing roller 431 due to the leading edge parts 4513 of the separation claws 451 butting against the surface of the second pressing roller 431, and for example, during printing on both sides, it is possible to prevent the toner image on the reverse side after both sides are printed being disturbed and becoming an image defect due to the contact marks.

Further, an air blowing section 47 was provided that blows air towards the side on the downstream side of the nip region formed by the pressing section 43 and the heating section 42 where the separation claws 451 do not abut, and the sheet P was separated due to the blast of air.

The air blowing section 47 is provided with a first air blowing section 471 that blows air towards the nip region N at all times, and a second air blowing section 472 that blows air towards the nip region from immediately before the time that the leading edge part P1 of the sheet enters the nip region N until the leading edge part P1 of the sheet has completed its passage through the nip region N.

The first air blowing section 471 is provided with a fan 4711 that operates at all times and a first nozzle 4712 that causes the air flow generated from the fan 4711 to flow up to near the nip region N and blows it towards the nip region N, and the first air blowing section 471 has the function of separating the sheet P from the heating belt 421.

As the fan 4711, it is possible to use sirocco fans that generate static pressures of about 1200 Pa, and it is possible to place a plurality of them, such as, for example, three fans.

Further, from the point of view of reducing the power consumption, it is also good to make the control section C activate the fan 4711 when the sheet P is passing through the nip region N.

A second air blowing section 472 is provided with a solenoid valve 4721 that switches ON and OFF the air A1 sent from a compressor not shown in the figure, and a second nozzle 4722 that causes the air A1 to flow up to near the nip region N and blows it towards the nip region N, and the second air blowing section 472 has the function of separating the sheet P from the heating belt 421.

Further, the solenoid valve 4721 is made ON by the control section C from immediately before the tip part P1 of the sheet enters the nip region N until the leading edge part P1 of the sheet has completed its passage through the nip region N.

Here, the air flow speed of the air ejected from the second nozzle 4722 is faster than the speed of the air ejected from the first nozzle 4712.

Also, even the air blowing section 47 can be moved in a reciprocating manner in the perpendicular direction X by the separation claw moving section 452 so that the positions of the first nozzle 4712 and the second nozzle 4722 in the perpendicular direction and the position of the sheet do not change.

Further, since the stiffness of the sheet becomes lower as the basis weight of the sheet becomes smaller (for example, 80 g/m$^2$ or less), when the air blowing section 47 is provided, particularly depending on the air flow of the air blowing section 47 after the sheet is separated from the heating belt 421, it is pushed towards the second pressing roller 431. In addition, it can easily bend in the X direction.

Because of this, compared to when there is no blowing of air, the extent to which the dependence on supplementation of peeling by the separation claws 451 is strong, and it is necessary to suppress to a small value the position shift in the X direction of the end part of the sheet and the separation claws 451. In a system in which the separation performance has been increased by the blowing of air, the effect of the invention of the present application is high.

Explaining the effect of the air blowing section 47, particularly when the amount of toner is high such as in the case of a color toner image, there is the problem that contact marks can be generated easily in that toner image that has not sufficiently been cooled after being melted during fixing, for example, when the separation claws or the like come into physical contact with the toner image.

Regarding this problem, because of making it possible to separate the sheet P in a non-contacting manner by the air from the first air blowing section 471 and the second air blowing section 472, not only it has become possible to separate certainly the sheet P from the heating belt 421, but also it was possible to avoid the generation of the contact marks described above.

Figure 3A:
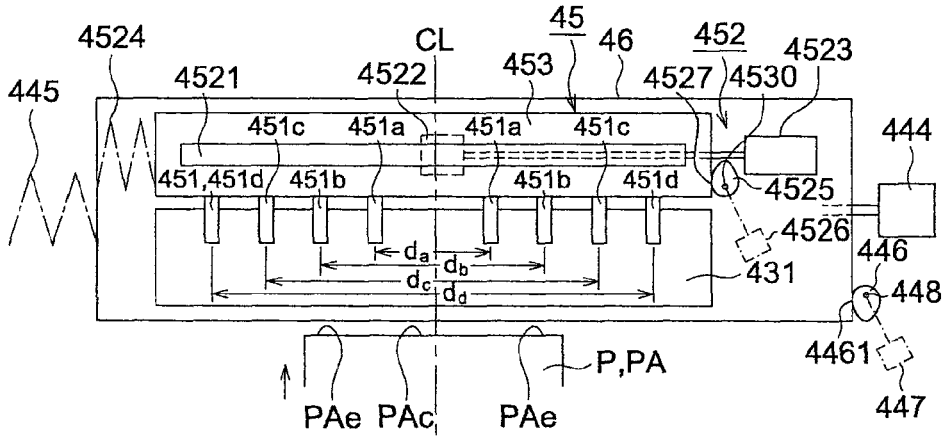
FIGS. 3A to 3C are explanatory diagrams (top plan view diagrams) of the fixing device 4*a* of the first preferred embodiment.
Figure 3B:
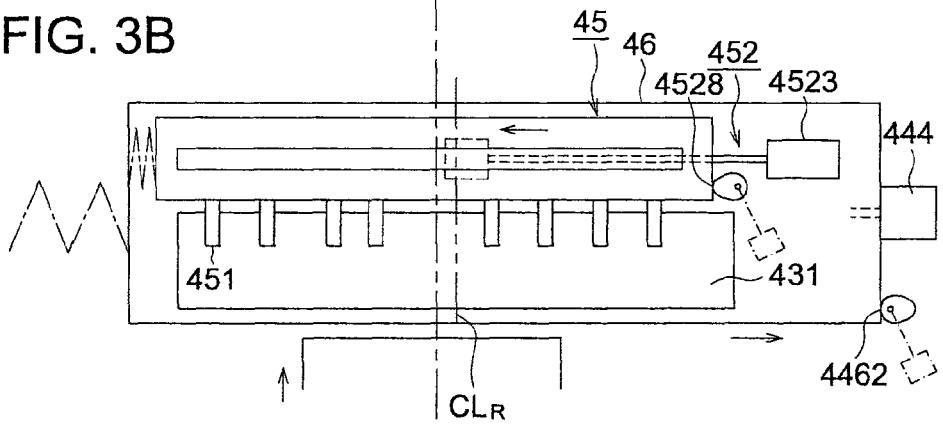
Figure 3C:
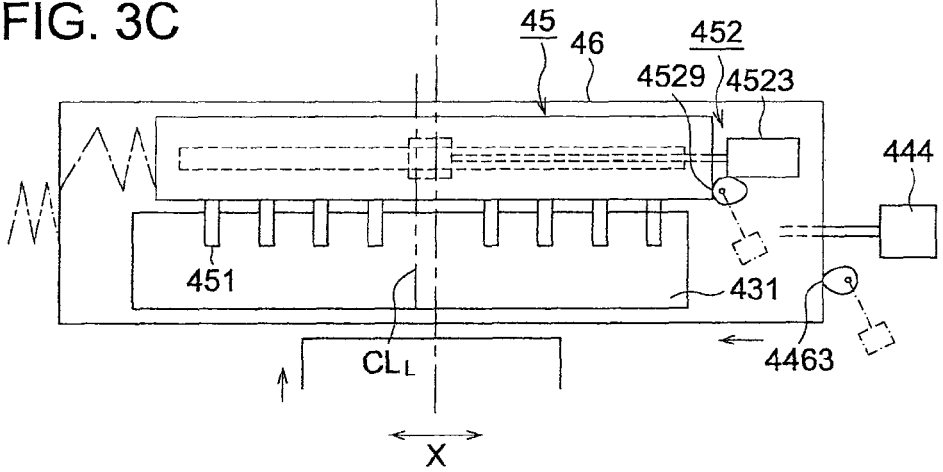

FIGS. 3A to 3C are explanatory diagrams (plan view diagrams) seen from above of the fixing device 4*a* according to a first preferred embodiment.

In the following, the positional relationship in the perpendicular direction X of the second pressing roller 431, the plurality of separation claws 451, and the sheet P is explained.

However, the air blowing section 47 and the heating section 42 have been omitted in order to make the figure easy to understand. In addition, as was described above, the explanations are given assuming that the sheet is conveyed by making its central part (perpendicular direction X) match the reference position CL (single-dot and dash line).

Although the heating section 42, the pressing section 43, and the separating section 45 are installed inside the fixing unit frame 46 and are moved in a reciprocating manner by the fixing unit moving section 44, the separation claws are installed inside the separation claw frame 453 and are moved in a reciprocating manner by the separation claw moving section 452, in the following regarding the reciprocating movement, the second pressing roller 431 or the pressing roller 431' to be described later is sometimes explained representing the fixing unit frame 46, and the separation claws 451 is sometimes explained representing the separation claw frame 453.

The plurality of separation claws 451, in the perpendicular direction X, is placed in pairs corresponding to the respective targets taking the central part of the plurality of separation claws 451 as the center. These pairs are placed in the sequence of the first pair of separation claws 451*a*, the second pair of separation claws 451*b*, the third pair of separation claws 451*c*, and the fourth pair of separation claws 451*d*.

Further, the pair of separation claws constituting the first pair of separation claws 451*a* is placed near the center of the sheet with a prescribed distance between the separation claws, and each of the pairs of separation claws constituting the second pair of separation claws 451*b*, the third pair of separation claws 451*c*, and the fourth pair of separation claws 451*d* are placed separated by a prescribed small dimension less than the width of the sheet of the corresponding sizes.

In the following, the explanation of the conveying of the sheet P is given assuming that a sheet PA of A4 size, which is a typical sheet size, is conveyed (in the longitudinal direction). In the following, an A4 size sheet is referred to as a sheet PA.

The first pair of separation claws 451*a* is installed at a spacing $d_a$ (for example, 60 mm). Because of this, for example, the part $PA_c$ near the center of the sheet PA is separated.

The second pair of separation claws 451*b* is positioned outside the first pair of separation claws 451*a* and are installed with a spacing $d_b$ (for example, 170 mm) larger than the spacing $d_a$. Because of this, for example, the parts PAe near the edges of the sheet PA (the width along the perpendicular direction is 210 mm) are separated.

The third pair of separation claws 451*c* is positioned outside the second pair of separation claws 451*b* and is installed with a spacing $d_c$ (for example, 237 ion) larger than the spacing $d_b$. Because of this, although this pair contributes to the separation of a sheet, for example, larger in size than the sheet PA, this pair does not contribute to the separation of the sheet PA.

The fourth pair of separation claws 451*d* is positioned outside the third pair of separation claws 451*c* and is installed with a spacing $d_d$ (for example, 277 mm) larger than the spacing $d_c$. Because of this, although this pair contributes to the separation of a sheet, for example, larger in size than the sheet PA, this pair does not contribute to the separation of the sheet PA.

FIG. 3A shows the condition in which the central parts of the second pressing roller 431 installed inside the fixing unit frame 46 and of the separating section 45 (separation claws 451) are positioned at the reference position CL (single dot and dash line).

The central parts of the second pressing roller 431 installed inside the fixing unit frame 46 and of the separating section 45 are positioned at the reference position CL (single dot and dash line) by the fixing unit moving motor 444 of the fixing unit moving section, and the central parts of the plurality of separation claws 451 (the first pair of separation claws 451*a*, the second pair of separation claws 451*b*, the third pair of separation claws 451*c*, and the fourth pair of separation claws 451*d*) are positioned at the reference position CL by the separation claw moving section 452.

Because of this, the first pair of separation claws 451*a* separates the part $PA_c$ near the center of the sheet PA that has got adhered to the second pressing roller 431, and the second pair of separation claws 451*b* separates the parts PAe near the edges of the sheet PA that has got adhered to the second pressing roller 431.

FIG. 3B shows the condition in which the central parts of the second pressing roller 431 installed inside the fixing unit frame 46 and of the separating section 45 (separation claws 451) have moved to the right shifted position $CL_R$ which is moved to the right of the reference position CL in the figure (double dots and dash line).

By moving the fixing unit frame 46 to the right in the figure by rotating the fixing unit moving motor 444 of the fixing unit moving section in the forward direction, the fixing unit frame 46 is moved up to the right shifted position $CL_R$ (double dots and dash line).

Due to the movement towards the right in the figure of the fixing unit frame 46, the separation claws 451 installed inside fixing unit frame 46 and the separation claw moving section 452 are moved towards the right in the figure.

However, so that the positional relationship between the plurality of separation claws 451 and the sheet P in the perpendicular direction X is always not shifted, the separation claw moving motor 4523 of the separation claw moving section 452 is rotated in the forward direction, thereby moving the separation claws 451 towards the left in the figure, and the central part of the plurality of separation claws is moved until it is at the reference position CL.

Here, for the sake of explanation, the explanations were given as if the operations of the fixing unit moving motor 444 and of the separation claw moving motor 4523 are carried out one after the other; however, in the present preferred embodiment, the fixing unit moving motor 444 and the separation claw moving motor 4523 are operated at the same time.

Further, as is explained later, when operating between a previously conveyed sheet and the sheet conveyed next to it, if the operation time is sufficiently short, it is also possible to configure so that the operations are made successively.

FIG. 3C shows the condition in which the central parts of the second pressing roller 431 installed inside the fixing unit 41 and of the separating section 45 (separation claws 451) have moved to the left shifted position $CL_L$ which is moved to the left of the reference position CL in the figure (double dots and dash line).

By moving the fixing unit frame 46 to the left in the figure by rotating the fixing unit moving motor 444 of the fixing unit moving section in the reverse direction, the fixing unit frame 46 is moved past the reference position CL, and is moved further towards the left shifted position $CL_L$ (double dots and dash line).

Due to the movement towards the left in the figure of the fixing unit frame 46, the separation claws 451 installed inside fixing unit frame 46 and the separation claw moving section 452 are moved towards the left in the figure.

However, so that the positional relationship between the plurality of separation claws 451 and the sheet P in the perpendicular direction X is always not shifted, the separation claw moving motor 4523 of the separation claw moving section 452 is rotated in the reverse direction moving the plurality of separation claws 451 towards the right in the figure, and the movement is made until the central part of the plurality of separation claws 451 is at the reference position CL.

Thereafter, the statuses of FIG. 3A, FIG. 3B, FIG. 3A, FIG. 3C, FIG. 3A, . . . are successively repeated until the image formation is ended.

Further, even during these movements, image forming is carried out and even fixing is carried out.

In order that the separation claws 451 do not scratch the surface of the second pressing roller 431 but their tip certainly touches the surface of the second pressing roller 431 and separates the sheet, it is necessary to maintain their positional relationship particularly with the second pressing roller 431 with a high accuracy.

For example, in the present preferred embodiment, the separation claws 451 are made to contact the second pressing roller 431 with a tip load of 3 to 5 mN per claw, and if the positional relationship between the second pressing roller 431 and the separation claws 451 are not maintained with a high accuracy, it is not possible to satisfy the mutually contradicting conditions of low load and certain contact.

In the present invention, since the separation claws 451 and the separation claw moving section 452 are being supported by the moving fixing unit frame 46, it is possible to maintain the positional relationship between the second pressing roller 431 and the separation claws 451 with a high accuracy, and it is possible to achieve both separation performance and reduction of damage to the second pressing roller.

In the above, although the fixing unit moving section 44 was explained for a construction using a rack gear 4521, a worm gear 4522, and a fixing unit moving motor 444, instead of these, it is also possible to provide a compressed spring 445 (single dot and dash line) that is positioned to the left in the figure of the fixing unit frame 46 and that pushes the fixing unit frame 46 towards the right in the figure, an eccentric cam 446 (single dot and dash line) positioned to the right of the fixing unit frame 46, and a motor 447 (single dot and clash line) that rotates the eccentric cam 446.

In the above, although the separation claw moving section 452 was explained for a construction using a rack gear 4521, a worm gear 4522, and a separation claw moving motor 4523, instead of these, it is also possible to provide a compressed spring 4524 (single dot and dash line) that is positioned to the left in the figure of the separation claw frame 453 and that pushes the separation claw frame 453 towards the right in the figure, an eccentric cam 4525 (single dot and dash line) positioned to the right of the separation claw frame 453, and a motor 4526 (single dot and dash line) that rotates the eccentric cam 4525.

In the following, the construction of carrying out reciprocating movement of the fixing unit frame 46 and the separation claw frame 453 is explained referring to FIG. 3A to FIG. 3C.

The motor 447 and the cam shaft 448 coupled to the output shaft of the motor 447 are fixed to the frame of the image forming apparatus, and reciprocating movement in the perpendicular direction of the fixing unit frame 46 can be made by the rotations of the motor 447.

Further, the motor 4526 and the rotating shaft 4530 of the eccentric cam 4525 are fixed to the fixing unit frame 46, and reciprocating movement in the perpendicular direction of the separation claw frame 453 can be made by the rotations of the motor 4526.

The eccentric cam 446 has a short diameter part 4462, an intermediate diameter part 4461, and a long diameter part 4463, and the distance from the axis of rotation to the outer shape of the cam becomes longer in the sequence of short diameter part 4462, intermediate diameter part 4461, and long diameter part 4463.

Further, the eccentric cam 4525 has a short diameter part 4462, an intermediate diameter part 4461, and a long diameter part 4463, and the distance from the axis of rotation to the outer shape of the cam becomes longer in the sequence of short diameter part 4462, intermediate diameter part 4461, and long diameter part 4463.

Further, the distances from the axis of rotation to the outer shape of the cam are the respectively the same for the short diameter part 4462 and short diameter part 4462, the intermediate diameter part 4461 and the intermediate diameter part 4461, and the long diameter part 4463 and the long diameter part 4463 (they have the same shapes).

Further, the eccentric cam 446 and the eccentric cam 4525 are installed so that when the short diameter part 4462 of the eccentric cam 446 is facing the fixing unit frame 46, the long diameter part 4463 of the eccentric cam 4525 is facing the separation claw frame 453. That is, the installations are done so that the phase of the eccentric cam 446 with respect to the fixing unit frame 46 and the phase of the eccentric cam 4525 with respect to the separation claw frame 453 are opposite.

In FIG. 3A, the eccentric cam 446 has been positioned by the motor 447 to the angle at which the external diameter of the intermediate diameter part 4461 is contacting the fixing unit frame 46, and the central part of the second pressing roller 431 installed inside the fixing unit frame 46 is positioned at the reference position CL (single dot and dash line).

Next, the eccentric cam 4525 has been positioned by the motor 4526 to the angle at which the external diameter of the intermediate diameter part 4527 is contacting the separation claw frame 453, and the central part of the plurality of separation claws 451 is positioned at the reference position CL (single dot and dash line).

Further, in FIG. 3B, the eccentric cam 446 is rotated by the motor 447 to an angle at which the external diameter of the short diameter part 4462 is contacting the fixing unit frame 46, and the central part of the second pressing roller 431 installed inside the fixing unit frame 46 has moved to the right shifted position $CL_R$ (double dots and dash line).

Next, the eccentric cam 4525 is rotated by the motor 4526 to an angle at which the external diameter of the long diameter part 4528 is contacting the separation claw frame 453, and the central part of the plurality of separation claws 451 is continuing to be positioned at the reference position CL (single dot and dash line).

Further, in FIG. 3C, the eccentric cam 446 is rotated by the motor 447 to an angle at which the external diameter of the long diameter part 4463 is contacting the fixing unit frame 46, and the central part of the second pressing roller 431 installed inside the fixing unit frame 46 has moved to the left shifted position $CL_L$ (double dots and dash line).

Next, the eccentric cam 4525 is rotated by the motor 4526 to an angle at which the external diameter of the short diameter part 4529 is contacting the separation claw frame 453, and the central part of the plurality of separation claws 451 is continuing to be positioned at the reference position CL (single dot and dash line).

As has been explained above, corresponding to the movement of the fixing unit frame 46 (the second pressing roller 431) by the fixing unit moving section 44, by moving the plurality of separation claws 451 using the separation claw moving section 452 to the side opposite to the direction of movement of the second pressing roller 431, it is possible to prevent the positional relationship between the plurality of separation claws 451 and the sheet P from changing, and to certainly separate from the second pressing roller 431 the sheet P that has been pressed towards the second pressing roller 431 due to the air blown by the first air blowing section 471 and the second air blowing section 472.

Although the case in which an A4 size sheet is conveyed was described above, based on a similar technical concept, even when conveying sheets of other sizes (for example, A5, B5, B4, etc.), or when conveying the sheet vertically or horizontally, it goes without saying that it is possible to prevent the positional relationship between the plurality of separation claws 451 and the sheet P from changing, and to certainly separate the sheet P that has adhered to the second pressing roller 431.

In this case, the separation claws are provided at the positions corresponding to the two end parts of the sheet of different sizes.

Figure 4:
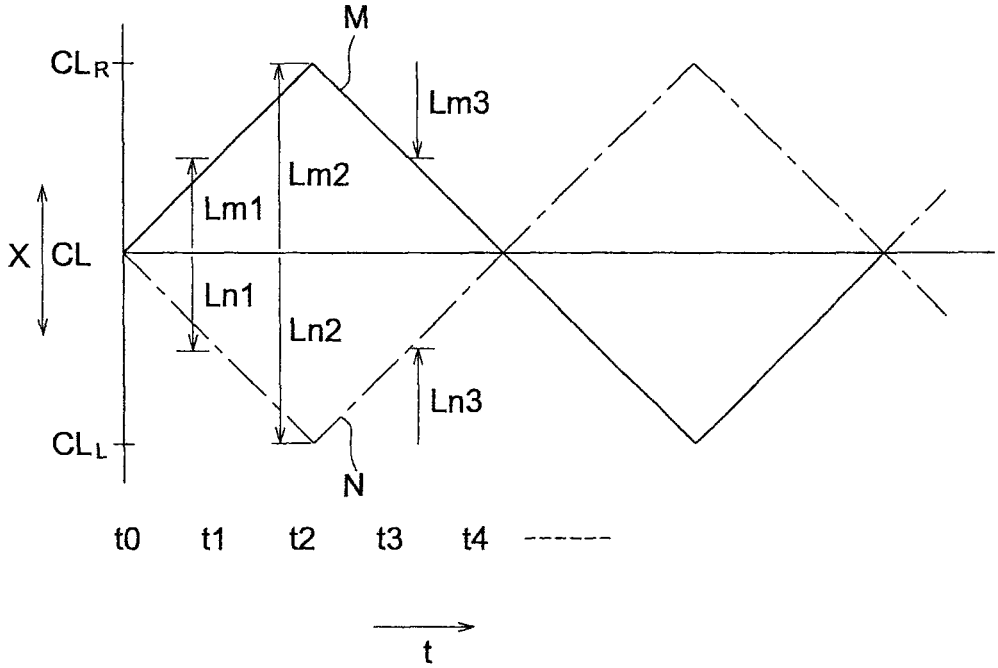
FIG. 4 is a conceptual diagram for explaining the positional relationship in the perpendicular direction X between the second pressing roller and the separation claw 451.

FIG. 4 is a conceptual diagram for explaining the positional relationship in the perpendicular direction X between the second pressing roller and the separation claws 451.

The horizontal axis represents the time t and the vertical axis represents the path of the movement trajectories of the different central parts of the second pressing roller 431 and the separations claws 451 in the perpendicular direction X.

Further, in this figure, the upward side represents the direction of moving towards the right shifted position $CL_R$, the downward side represents the direction of moving towards the left shifted position $CL_L$, the trajectory of the central part of the second pressing roller 431 is indicated by a continuous line M, and the trajectory of the central part of the separation claws 451 is indicated by a single dot and dash line N.

At time 0, the central part of the second pressing roller 431 (continuous line M) and the central part of the separation claws 451 (broken line N) are respectively at the reference position CL.

After a time t1, the central part of the second pressing roller 431 (continuous line M) is moving from the reference position CL towards the right shifted position $CL_R$, and the central part of the separation claws 451 (broken line N) is moving from the reference position CL towards the left shifted position $CL_L$.

At this time, since the distance of movement Lm1 of the central part of the second pressing roller 431 from the reference position CL towards the right shifted position $CL_R$, and the distance of movement Ln1 of the central part of the separation claws 451 from the reference position CL towards the left shifted position $CL_L$ are the same, the positional relationship does not change between the sheet P which is always conveyed with the reference position CL as its center and the separation claws 451.

After a time t2, the central part of the second pressing roller 431 (continuous line M) has completed its movement up to the right shifted position $CL_R$, and the central part of the separation claws 451 (broken line N) has completed its movement up to the left shifted position $CL_L$.

Here, since the distance of movement Lm2 of the central part of the second pressing roller 431 from the reference position CL up to the right shifted position $CL_R$, and the distance of movement Ln2 of the central part of the separation claws 451 from the reference position CL up to the left shifted position $CL_L$ are the same, the positional relationship does not change between the sheet P which is always conveyed with the reference position CL as its center and the separation claws 451.

After a time t3, the central part of the second pressing roller 431 (continuous line M) is moving from the right shifted position $CL_R$ towards the reference position CL, and the central part of the separation claws 451 (broken line N) is moving from the left shifted position $CL_L$ towards the reference position CL.

At this time, since the distance of movement Lm3 of the central part of the second pressing roller 431 from the right shifted position $CL_R$ towards the left shifted position $CL_L$, and the distance of movement Ln3 of the central part of the separation claws 451 from the left shifted position $CL_L$ towards the right shifted position $CL_R$ are the same, the positional relationship does not change between the sheet P which is always conveyed with the reference position CL as its center and the separation claws 451.

After a time t4, the central part of the second pressing roller 431 (continuous line M) and the central part of the separation claws 451 (broken line N) have again arrived at the reference position CL.

Thereafter, since the second pressing roller 431 and the separation claws 451 repeat the operations from time t0 to time t4, the positional relationship between the sheet P and the separation claws 451 are unchanged at all times.

Further, although the speed of movement of the second pressure roller 431 (the slope of the continuous line M) can be any speed as long as it is a speed that does not affect the condition of fixing, does not affect the condition of conveying the sheet, and also makes vague the change in the condition of fixing (for example, glossiness) at the border between the area in which the sheet is conveyed and the area in which the sheet is not conveyed, this speed should be set, for example, at about 0.05 mm/s.

Further, in order to make the speed of movement of the separation claws 451 (the slope of the single dot and dash line N) and the speed of the second pressing roller 431 (the slope of the continuous line M) match, this should be set, for example at 0.05 mm/s which is the speed of movement of the second pressing roller 431.

Further, the distance of movement of the second pressing roller 431 and of the separation claws 451 from the reference position CL to the right shifted position $CL_R$, and the distance of movement from the reference position CL to the left shifted position $CL_L$ should be set equal to each other, for example, they be set to about 10 mm.

Figure 5:
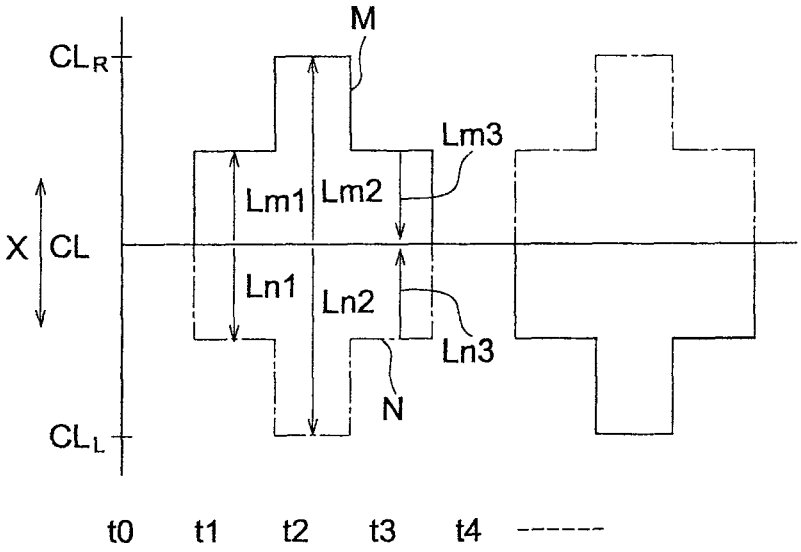
FIG. 5 is an explanatory diagram for the case in which the fixing unit frame 46 and the separating section 45 move intermittently.

FIG. 5 is an explanatory diagram for the case in which the fixing unit frame 46 and the separating section 45 move intermittently.

The horizontal axis represents the time t and the vertical axis represents the path of the movement trajectories of the different central parts of the second pressing roller 431 and the separations claws 451 in the perpendicular direction X.

Further, in this figure, the upward side represents the direction of moving towards the right shifted position $CL_R$, the downward side represents the direction of moving towards the left shifted position $CL_L$, the trajectory of the central part of the second pressing roller 431 is indicated by a continuous line M, and the trajectory of the central part of the separation claws 451 is indicated by a single dot and dash line N.

At time 0, the central part of the second pressing roller 431 (continuous line M) and the central part of the separation claws 451 (broken line N) are respectively at the reference position CL.

After a time t1, the central part of the second pressing roller 431 (continuous line M) has moved by about half the distance up to the right shifted position $CL_R$, and the central part of the separation claws 451 (broken line N) has moved by about half the distance up to the left shifted position $CL_L$.

At this time, since the distance of movement Lm1 of the central part of the second pressing roller 431 from the reference position CL towards the right shifted position $CL_R$, and the distance of movement Ln1 of the central part of the separation claws 451 from the reference position CL towards the left shifted position $CL_L$ are the same, the positional relationship between the sheet P and the separation claws 451 at after the time t1 does not change.

After a time t2, the central part of the second pressing roller 431 (continuous line M) has completed its movement up to the right shifted position $CL_R$, and the central part of the separation claws 451 (broken line N) has completed its movement up to the left shifted position $CL_L$.

Here, since the distance of movement Lm2 of the central part of the second pressing roller 431 from the reference position CL up to the right shifted position $CL_R$, and the distance of movement Ln2 of the central part of the separation claws 451 from the reference position CL up to the left shifted position $CL_L$ are the same, the positional relationship between the sheet P and the separation claws 451 after the time t2 does not change.

After a time t3, the central part of the second pressing roller 431 (continuous line M) has moved by about half the distance up to the right shifted position $CL_R$, and the central part of the separation claws 451 (broken line N) has moved by about half the distance up to the left shifted position $CL_L$.

At this time, since the distance of movement Lm3 of the central part of the second pressing roller 431 from the right shifted position $CL_R$ towards the left shifted position $CL_L$, and the distance of movement Ln3 of the central part of the separation claws 451 from the left shifted position $CL_L$ towards the right shifted position $CL_R$ are the same, the positional relationship between the sheet P and the separation claws 451 after the time t3 does not change.

After a time t4, the central part of the second pressing roller 431 and the central part of the separation claws 451 have again arrived at the reference position CL.

Thereafter, since the second pressing roller 431 and the separation claws 451 repeat the operations from time t0 to time t4, the positional relationship between the sheet P and the separation claws 451 are unchanged after intermittent operation.

In what has been shown in the above figure, in order to make intermittent operation easy to understand, the movement trajectory M of the central part of the second pressing roller 431 and the movement trajectory N of the central part of the separation claws 451 have been shown to be rectangular in shape; however, it goes without saying that, in stricter terms, the vertical parts have a prescribed slope.

The movements of the second pressing roller 431 and the separation claws 451 described above are carried out by intermittently rotating by the same number of revolutions the fixing unit moving motor 444 of the fixing unit moving section 44 and the separation claw moving motor 4523 of the separation claw moving section 452, respectively.

Therefore, these intermittent movements of the second pressing roller 431 and of the separation claws 451 are carried out during the period when no sheet is being conveyed through the fixing device 4, for example, during the operation of changing the sheet size, and during the period when the image formation has been suspended at prescribed intervals of time, or during one of these periods.

By carrying out the movement of the second pressing roller 431 and the movement of the separation claws 4541 in this manner when no sheet is being conveyed through the fixing device 4, it is possible to prevent conveying errors caused by position shift in the perpendicular direction X of the roller and sheet, and abnormalities in the condition after fixing.

Further, in the figures, although the second pressing roller 431 and the separation claws 451 were moved in two stages, it goes without saying that it is also good to make these movements in a plurality of stages, for example, 5 stages, or even 10 stages.

Further, it is also possible to move the second pressing roller 431 continuously as shown in FIG. 4 and to move the separation claws 451 intermittently, as long as the conveying state of the sheet is not disturbed, and the separation claws that ought to contact between one end part of the sheet and the other end part of the sheet do not go beyond and impede the separation performance.

Although the pattern of carrying out reciprocating movement is not limited to those explained using FIG. 4 and FIG. 5, in order to make more vague the border between the area where the end part of the sheet is positioned and the area where the end part of the sheet is not positioned on the heating belt 421, it is possible to select various patterns. The present invention can be applied to any such movement pattern and also effects can be obtained.

Further, instead of the fixing unit moving motor 444 of the fixing unit moving section 44, and the separation claw moving motor 4523 of the separation claw moving section 452, it is also good to move the fixing unit moving section 44 and the separation claw moving section 452 intermittently using solenoids.

By using solenoids in place of motors, it becomes possible to simplify the construction, and also possible to make the control simpler.

Figure 6:
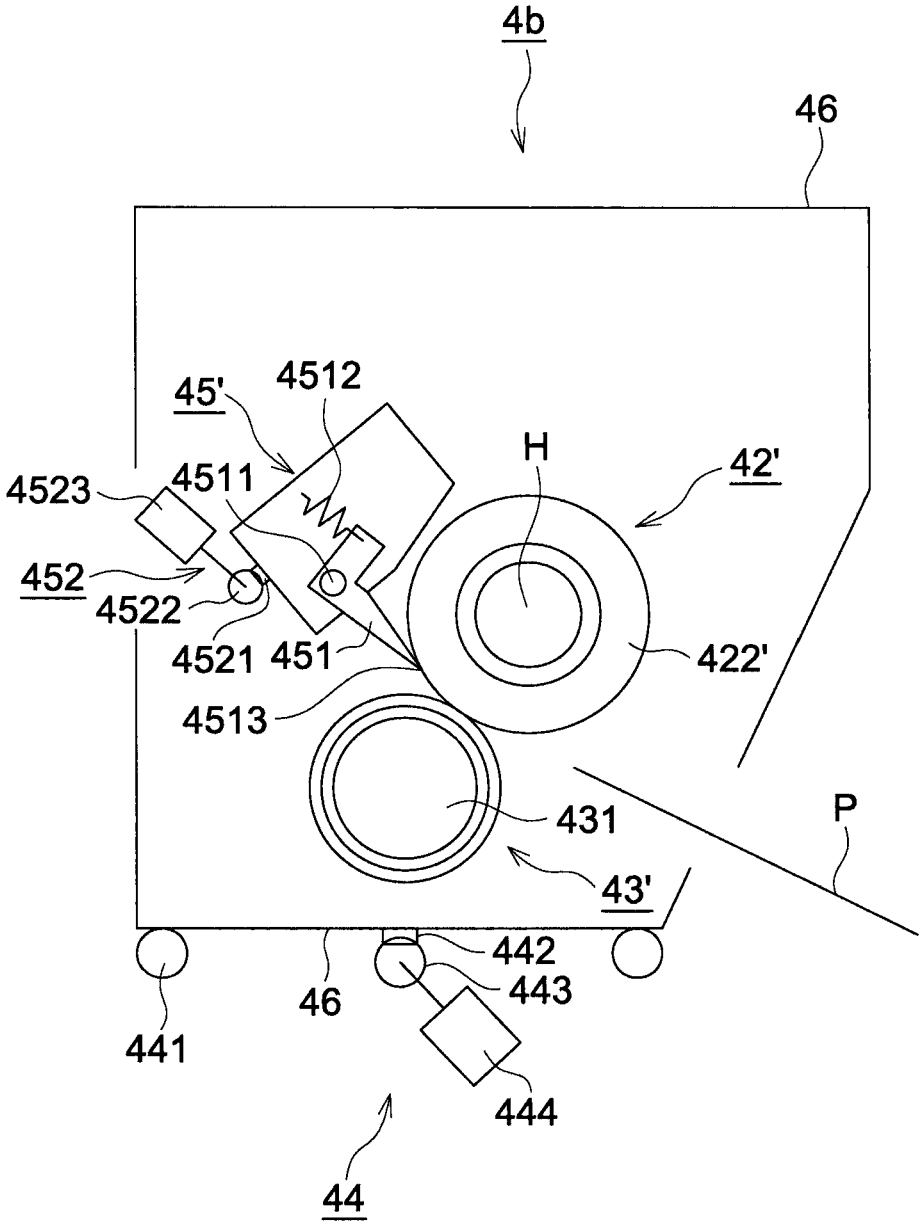
FIG. 6 is an explanatory diagram (side view diagram) of a fixing device according to a second preferred embodiment.

FIG. 6 is an explanatory diagram of a fixing device according to a second preferred embodiment (side view diagram).

The fixing device 4*b* of the second preferred embodiment is provided with a heating section 42' for heating the sheet P, a pressing section 43' for pressing the sheet P against the heating section 42', a fixing unit moving section 44 that carries out reciprocating movement of at least the heating section 42' and the pressing section 43' in the perpendicular direction X (the sheet surface top to bottom direction), and a separating section 45' that separates the sheet P from the heating section 42'.

The separating section 45' is provided with separation claws 451 that separate the sheet P from the heating section 42', and a separation claw moving section 452 that moves in a reciprocating manner the separation claws 451 in a perpendicular direction X.

Further, the fixing device 4*b* of the second preferred embodiment has the same construction as the fixing device 4*a* of the first preferred embodiment excepting that the heating section 42' is configured as a heating roller 422' with a built-in heater H, the sheet P is pressed against the heating roller 422' by the pressing roller 431 of the pressing section 43', the separating section separates the sheet P adhered to the heating roller 422' using the separation claws 451, and that this device does not have an air blowing section 47.

In the following the heating section 42', the pressing section 43', and the separating section 45' that are different from the fixing device 4*a* of the first preferred embodiment are explained. However, members similar to those in the fixing device 4*a* of the first preferred embodiment are assigned the same symbols and their explanations are omitted.

The heating section 42' is installed inside the fixing unit frame 46, and has a heating roller 422' with a built-in heater H.

The heating roller 422' is, for example, a roller with an external diameter of, for example, about 70 mm, is a cylindrical metal roller as the base the surface of which is covered with silicone rubber (hardness of 30 degrees: JISA) with a thickness of about 0.5 mm, and PFA (tetra fluoro ethylene and perfluoroalkyl vinyl ether copolymer).

The heater H incorporated inside the heating roller 422' is constructed, for example, from a halogen lamp or the like, and is controlled by the control section C so that the temperature of the heating roller 422' becomes 160° C. to 200° C.

The pressing section 43' is installed inside the fixing unit frame 46, and has a pressing roller 431. However, a separating section is not placed for the pressing section 43'.

The separating section 45' is provided on the side of the heating section 42' for separating the sheet P adhered to the heating roller 422'.

In the separating section 45', in order to make its performance of separating the sheet P from the heating roller 422' of the same level as that of the separating section 45 of the fixing device 4*a*, the relationship of the separation claws 451 with the heating roller 422' is made similar to that of the separation claws 451 of the fixing device 4*a*.

In other words, the separation section 45' is installed on the extended surface of the conveying surface of the sheet P (horizontal direction Y) while being inverted in the up-down direction compared to the separating section 45 of the fixing device 4*a* of the first preferred embodiment.

Also, the separation claw moving section 452 has been installed on the underside of the separating section 45'.

Further, the separation claws 451 are configured to have a plurality of them similar to the explanation given referring to FIG. 3A to FIG. 3C, and their tip parts 4513 butt against the surface of the heating roller 422', thereby making it possible to separate the sheet P that has got adhered to the heating roller 422'.

However, if it has been confirmed by experiments or the like that the probability of the sheet P getting adhered to and wound around the heating roller 422' is low, it is also possible to place so that the tip parts 4513 of the of separation claws 451 are separated slightly from the surface of the heating roller 422'. By separating, it is possible to prevent the generation of scratches on the heating roller 422'.

The fixing unit moving section 44 moves the fixing unit frame 46 in a reciprocating manner in the perpendicular direction X, and the separation claw moving section 452 moves the separation claws 451 in a direction opposite to the direction of movement of the fixing unit frame 46 by the fixing unit moving section 44. Because of this, the positional relationship in the perpendicular direction X between the position of the separation claws 451 and the sheet P becomes fixed, and it is possible to separate the sheet P certainly from the heating roller 422'.

As has been explained above, in the perpendicular direction X, by moving the heating roller 422' and the pressing roller 431' with respect to the sheet that is conveyed at a fixed position (the reference position CL) using the fixing unit moving section 44, differences in the glossiness or the like between the area in which the sheet is conveyed and the area in which the sheet is not conveyed bordering on the border between them has been made not to stand out.

Further, because the tip parts 4513 of the separation claws 451 butt against the surface of the heating roller 422', the tip part P1 of a fixed sheet that has got adhered to the heating roller 422' is scooped up, and it was made possible to separate from the heating roller 422' the sheet P that has got adhered to the heating roller 422'.

Further, in the reciprocating movement of the separation claws 451 and the reciprocating movement of the fixing unit frame 46, by making the directions of their movement opposite to each other, and also by making the distances and speeds of movement identical in both, the positional relationship between the position of the separation claws 451 and the sheet P is made fixed, and it has been made possible to separate certainly the sheet P from the second pressure roller 431.

Further, in the present preferred embodiment, although separation claws were not provided for the pressure roller 431, it goes without saying that it is possible to obtain more certain sheet conveying performance by providing separation claws for both the heating roller 422' and the pressure roller 431, and in addition, it is also possible to configure these two separation claws movable and to make them move in a similar manner.

Further, when the external diameter of the heating roller 422' is small, for example, when less than about 40 mm, curvature separation effect acts strongly on the sheet, so it is easy for the sheet P to separate naturally from the heating roller 422'. Because of this, the separation claws 451 are not made to butt against the surface of the heating roller 422' but are separated from it by a very small distance.

Because of this, by making the separation claws 451 and the heating roller 422' non-contacting, it is possible to prevent wear of the tips of the separation claws and wear of the surface of the heating roller 422', and it becomes possible to greatly reduce the frequency of the replacement of the separation claws 451 and the heating roller 422' and the number of maintenance operations due to the adhesion of wearing dust.

In the present preferred embodiment, the separation claws 451 are maintained at a tip separation of 0.3 to 0.5 mm from the heating roller 422', and the tips of the separation claws 451 are inserted in the gap generated between the tip of the sheet and the heating roller 422' thereby separating them.

Because of this, if the positional relationship between the heating roller 422' and the separation claws 451 is not maintained fixed with a high accuracy, it is not possible to satisfy the mutually contradicting conditions of non-contacting and maintaining the separation supporting function.

In the embodiment of the present invention, since the separation claws 451 and the separation claw moving section 452 are being supported by the moving fixing unit frame 46, it is possible to maintain the positional relationship between the heating roller 422' and the separation claws 451 with a high accuracy, and it is possible to achieve both maintaining the separation supporting function and preventing damage to the heating roller 422'.

Figure 7:
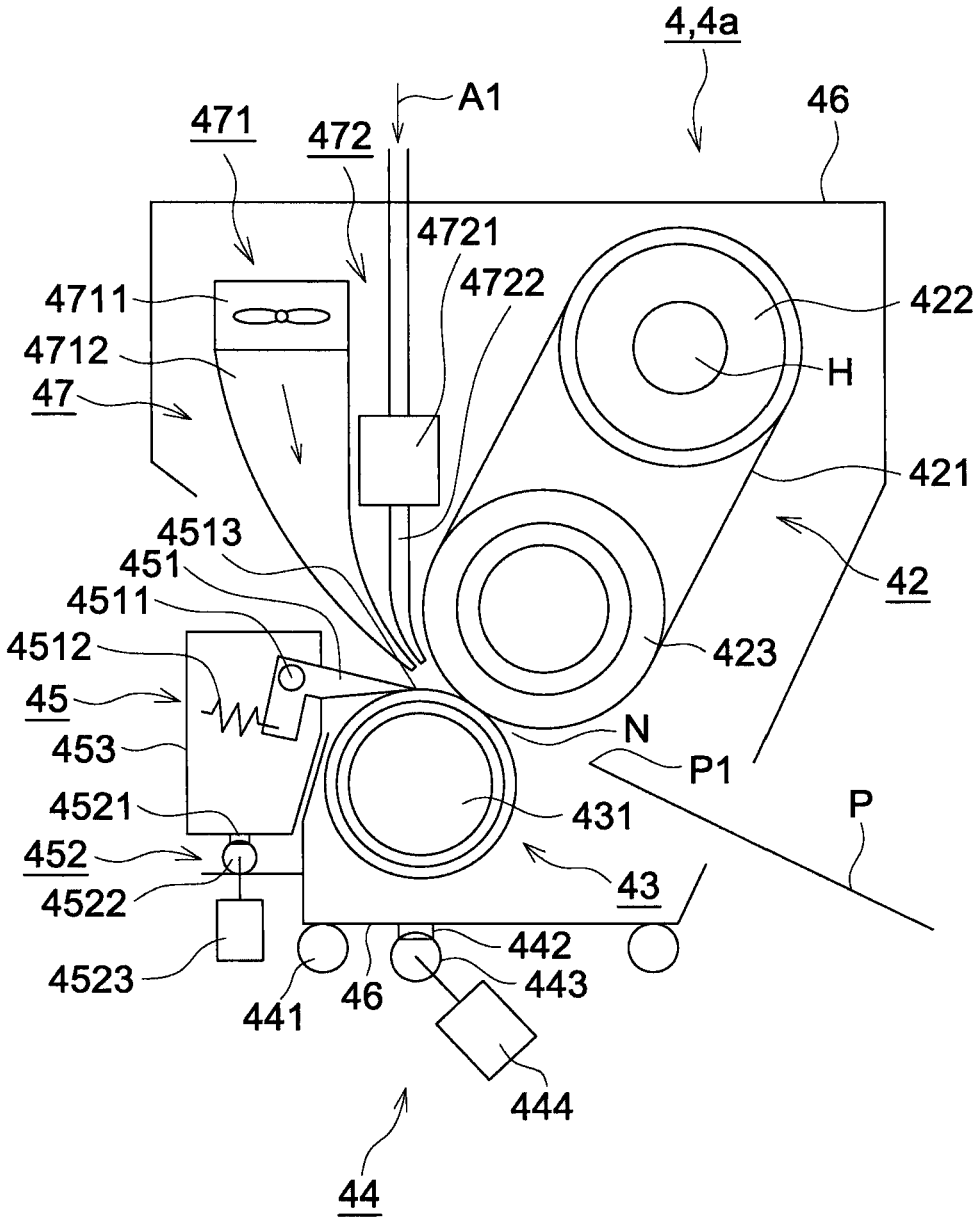
FIG. 7 is an explanatory diagram (side view diagram) of a third preferred embodiment of the fixing device.

FIG. 7 shows a third preferred embodiment. In this figure, the members identical to FIG. 2 are indicated by the same numbers. Although in FIG. 2 explanations are given for an example in which the separation section 45 or the like are placed inside the fixing unit frame 46, in the present preferred embodiment, the separation section 45 or the like are placed outside the fixing unit frame 46, and the configuration is such that the separation claws 451 are inserted towards the nip region N. The separation section 45 is moved in the X direction (as shown in FIG. 3) at right angles to the sheet conveying direction, relative to the fixing unit frame 46, by a motor 4523 which is supported by the fixing unit frame 46 via a worm gear 4522 and a rack gear 4521. Since the separation section 45 is being supported by the fixing unit frame 46, it is possible to maintain with a high accuracy the positional relationship between the pressing roller 431 and the separation claws 451, and it is possible to acquire separation capacity.

By installing the separation section 45 outside the fixing unit frame 46 in this manner, it is possible to carry out easily the maintenance operations such as replacing the separation claws 451, or the like. In addition, it is possible to maintain at a low temperature the mechanism including the motor for moving the separation section 45, and the reliability and durability of the movement mechanism are enhanced.

Figure 8:
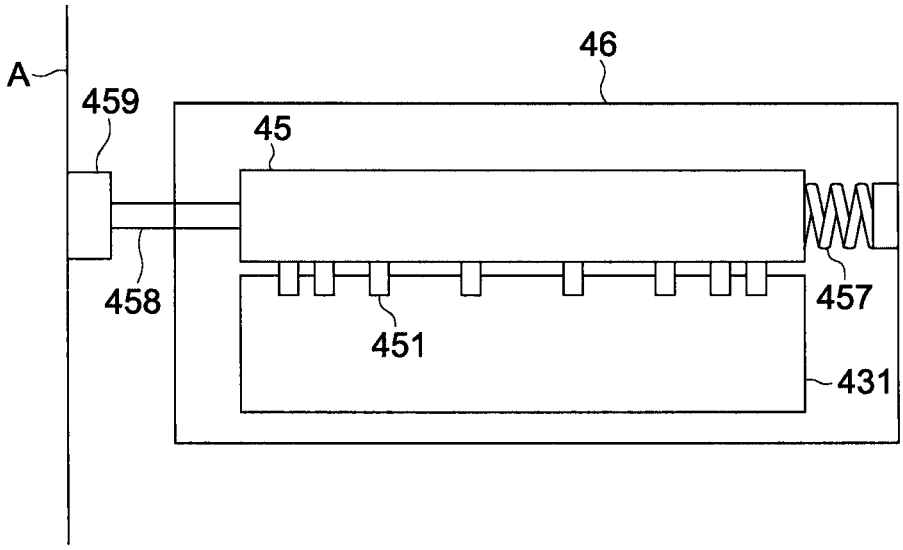
FIG. 8 is an explanatory diagram (top plan view diagram) of an example of another fixing device.

FIG. 8 shows a modified example of the fixing unit frame 46. The separation section 45 is supported inside the fixing unit frame 46 so that it can be moved in the X direction (as shown in FIG. 3) at right angles to the sheet conveying direction, a compression spring 457 is provided between the right end of the separation section 45 of FIG. 8 and the fixing unit frame 46 thereby pushing the separation section 45 towards the left in FIG. 8 relative to the fixing unit frame 46. A member 458 is provided at the right end of the separation section 45 for positioning, and this member butts against the member 459 that is fixed to the image forming apparatus A. Even if the fixing unit frame 46 moves relative to the image forming apparatus A in the direction X at right angles to the sheet conveying direction, since the separation section 45 is in a condition in which it has been pressed against the member 459 fixed to the image forming apparatus A, the positional relationship with the image forming apparatus, that is, the positional relationship with the sheet P does not change. Since the separation section 45 is being supported by the fixing unit frame 46, it is possible to maintain with a high accuracy the positional relationship between the tip of each separation claw 451 and the pressure roller 431. The position in the X direction at right angles to the sheet conveying direction, the position in the radial direction of the pressure roller 431 can both be maintained with the necessary accuracy, and it is possible to obtain sufficient separation capacity. In the present preferred embodiment, the compression spring 457 functions mainly as a separation claw moving section.

From the above preferred embodiments, it is possible to provide a fixing device that can suppress the generation of image deficiencies (uneven gloss or the like) and can prevent recording material separation failure, and by providing such a fixing device, it has been made possible to provide an image forming apparatus that can provide high quality output images and also with suppressed reductions in the operation rate.

What is claimed is:

1. A fixing device comprising:

(a) a heating section which heats a recording material;

(b) a pressing section which presses the recording material toward the heating section;

(c) a separation claw which separates the recording material from the heating section or the pressing section;

(d) a fixing unit moving section which reciprocates the heating section, the pressing section and the separation claw in a direction perpendicular to a conveyance direction of the recording material; and (e) a separation claw moving section which reciprocates the separation claw in the direction perpendicular to the conveyance direction, wherein the separation claw moving section moves the separation claw toward a direction opposite to a moving direction toward which the heating section, the pressing section and the separation claw move in the direction perpendicular to the conveyance direction.

2. The fixing device of claim 1, wherein the heating section, the pressing section, the separation claw, and the separation claw moving section are provided on a fixing unit frame that is movably supported and reciprocated by the fixing unit moving section in the direction perpendicular to the conveyance direction, and the separation claw moving section reciprocates the separation claw so that a change of a relative position of the separation claw with respect to a conveyance position of the recording material, which is caused by reciprocation movement of the fixing unit moving section, is canceled.

3. The fixing device of claim 2, wherein the fixing unit moving section continuously reciprocates the fixing unit frame, and the separation claw moving section continuously reciprocates the separation claw.

4. The fixing device of claim 2, wherein the separation claw moving section are provided inside the fixing unit frame.

5. The fixing device of claim 2, wherein the separation claw moving section are provided outside the fixing unit frame.

6. The fixing device of claim 1, wherein the separation claw comes into contact with the pressing section and separates the recording material from the pressing section.

7. The fixing device of claim 1, wherein the separation claw comes into contact with the heating section and separates the recording material from the heating section.

8. The fixing device of claim 1, further comprising an air blowing section provided on a downstream side of a nip portion between the heating section and the pressing section where the separation claw and the separation claw moving section are not arranged, which blows air against the nip portion thereby separates the recording material from the heating section or the pressing section.

9. An image forming apparatus comprising:

an image forming section which forms a toner image; and the fixing device of claim 1, which fixes the toner image formed by the image forming section onto a recording material.

* * * * *